US005782511A

United States Patent [19]

Schwarz

[11] Patent Number: 5,782,511

[45] Date of Patent: Jul. 21, 1998

[54] DECOMPRESSION LOCK

[75] Inventor: Helmut Schwarz, Weil der Stadt, Germany

[73] Assignee: Schwarz Verbindungs-Systeme GmbH, Althengstett, Germany

[21] Appl. No.: 775,341

[22] Filed: Jan. 3, 1997

[30] Foreign Application Priority Data

Jan. 13, 1996 [DE] Germany ..... 296 00 518 U

[51] Int. Cl.[6] ..... E05B 15/04; E05B 15/12; E05C 3/00; E05C 5/02

[52] U.S. Cl. ..... 292/219; 292/63; 292/198; 292/204; 292/209; 292/341.17

[58] Field of Search ..... 292/204, 209, 292/219, 341.17, 198, 63; 24/510, 567

[56] References Cited

U.S. PATENT DOCUMENTS

| | | | |
|---|---|---|---|
| 1,132,170 | 3/1915 | Dewinsky | 24/510 |
| 1,530,341 | 3/1925 | Bannochie | 292/219 |
| 2,132,806 | 10/1938 | Ruegg | 292/204 |
| 2,256,465 | 9/1941 | Brubaker | 292/198 |
| 3,105,992 | 10/1963 | Carlson | 16/82 |
| 3,942,828 | 3/1976 | Bourrie et al. | 292/201 |
| 4,135,746 | 1/1979 | Sterling | 292/92 |
| 4,358,141 | 11/1982 | Hamada | 292/216 |
| 5,048,239 | 9/1991 | Filitz et al. | 52/1 |

FOREIGN PATENT DOCUMENTS

| | | |
|---|---|---|
| 26 51 824 | 11/1976 | Germany . |
| 31 113 205 | 4/1981 | Germany . |
| 31 14 665 | 4/1982 | Germany . |
| 3114665 A1 | 10/1982 | Germany . |
| 2 214 975 | 9/1989 | United Kingdom . |

*Primary Examiner*—Kenneth J. Dorner
*Assistant Examiner*—Robert G. Santos
*Attorney, Agent, or Firm*—McDermott, Will & Emery

[57] ABSTRACT

The invention concerns decompression locks releasing a flap or plate from their closed position in the event of overpressure. A decompression lock, employing the known principle of overcoming the retaining force of a spring (14) to achieve opening, employs a bolt (11) rotatably supported in a longitudinally displaceable support carriage (8). A detent spring (14) keeps the bolt (11) in the closed position and will release it at a predetermined overpressure. During assembly or in the event of forced opening, the decompression lock is moved into the closed position solely by closing the flap or plate.

8 Claims, 3 Drawing Sheets

DECOMPRESSION LOCK

TECHNICAL FIELD

The invention concerns a decompression lock overcoming the retaining force of a spring to implement opening when a predetermined pressure is exceeded.

BACKGROUND ART

The purpose of decompression locks is to relieve excess pressures, herein overpressures, by releasing a door or a sealing plate from its closed position. Illustratively decompression locks are used in power plants to close safety flaps. This application is disclosed in the German patent 26 51 824, whereby a shear pin is mounted between the frame and the safety flap and will rupture in the case of overpressure and thus will allow opening the safety flap. This lock design incurs the drawback that the broken shear pin must be replaced after every flap opening. This drawback is avoided in the lock disclosed by the German patent document 31 13 205 C2 wherein a bolt affixed to a pressure-relief flap is held in place by two elastically supported levers having rollers at their ends. In the case of overpressure, the bolt forces the two levers outward and as a result the overpressure opens the pressure-relief flap. In order to operate with lesser force for closing than for opening, a device is needed to keep the spread levers open. The German patent document 31 14 665 discloses a pressure-relief aperture. A flap closing said aperture is kept in the closed position by a spring latch that yields in the event of overpressure to allow the flap to open. The last-discussed lock is ready for use again after overpressure-opening, however, just as the lock of the German patent document 31 13 205 C2, it is designed for heavy-machinery construction, very costly, and inadequate in compact form.

Illustratively decompression locks also are used in aircraft. In this field the decompression locks act on plates in partitions. In aircraft as well decompression locks are used wherein the tipping lever is held in the closed position by shear pins. These designs as well suffer from the drawbacks of the above discussed shear-pin locks.

The invention addresses the object of creating a preferably compact decompression lock such as are used in aircraft and which shall allow closure implemented in simple manner and which shall be immediately ready for use again following opening due to overpressure. The triggering pressure may be set in a wide range by suitably selecting several parameter values.

BEST MODE FOR CARRYING OUT THE INVENTION

Figure 1B:
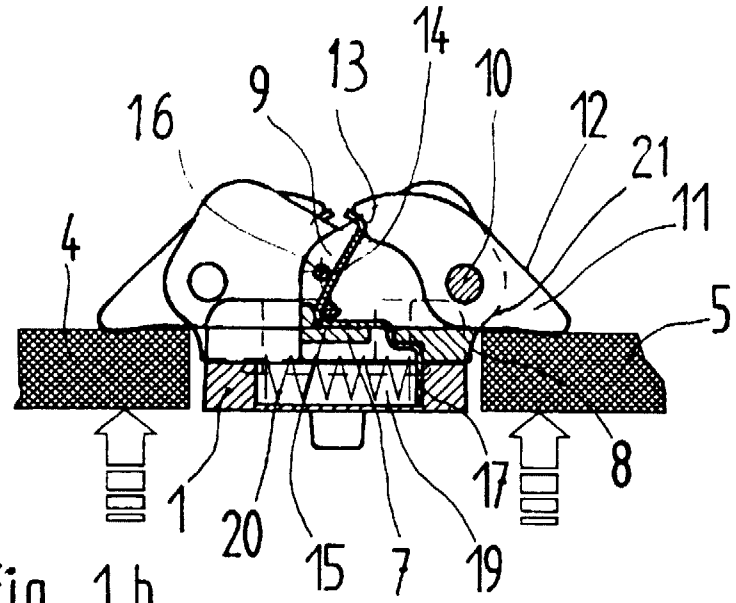

Illustrative embodiments of the invention are described below in relation to FIGS. 1 and 2. FIG. 1 shows three views of a preferred embodiment of a decompression lock. FIG. 2 shows sideviews of the various closing stages of the decompression lock of FIG. 1*b*, before, during and after opening due to overpressure.

The decompression locks of FIGS. 1 and 2 are mounted in tandem, that is two decompression locks operating in opposite directions are mounted alongside each other. This design is preferred in aircraft construction, several tandem locks being mounted on a sealing frame transversely to the longitudinal direction of said frame. Such a sealing frame allows sealing an aperture in a partition using a plate somewhat smaller than the aperture. Hinges are not needed in this design. During assembly, the sealing frame is first pressed onto the closing plate and thereupon the closing plate and the sealing frame are jointly mounted in the partition.

Even though the illustrative embodiments only show tandem locks, the invention nevertheless also covers individual decompression locks for instance designed to close a flap affixed to hinges.

Figure 1A:
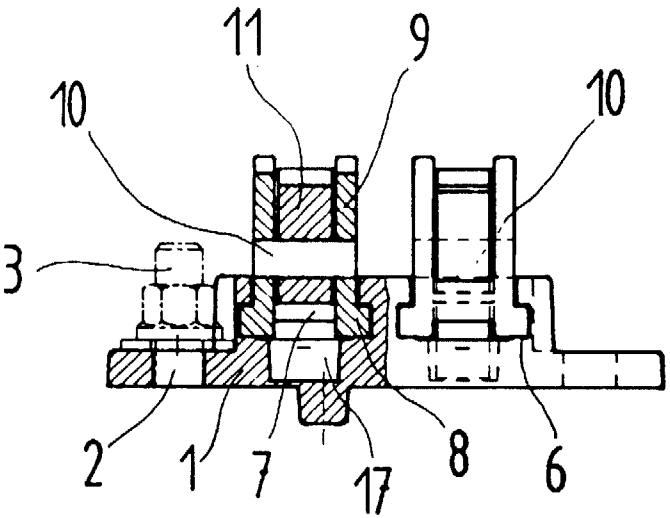
Figure 1C:
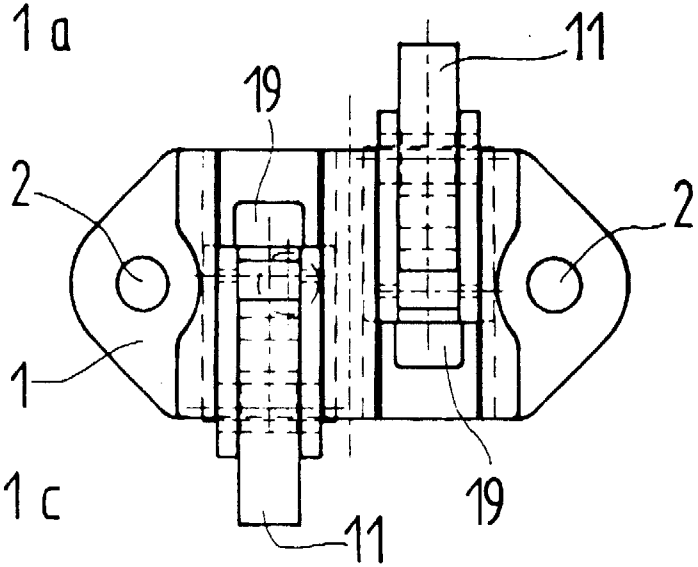

FIGS. 1*a*, 1*b* and 1*c* resp. are a front view, a side view and a top view of an embodiment of the invention. The tandem decompression lock design comprises a base plate 1 having two boreholes 2 allowing to affix said plate by screws 3 for instance to a sealing frame. As shown in FIG. 1*b*, the locks serve to keep two plates 4 and 5 in place. The cross-section of a sealing frame is understood to be present at the underside of the base plate 1, said frame extending from the underside of the plate 4 to the underside of the plate 5. Only one decompression lock, namely the one on the right-hand side in FIG. 1*b*, shall be described hereafter, the left-hand decompression lock being substantially identical, except being rotated around by 180° and acting in the opposite direction. It is frequently desired in practice that the two decompression locks operate at different overpressures, that is, not simultaneously. This feature can be implemented as described further below by appropriate selection of parameter values.

Two parallel T-channels 6 are present on the base plate 1, running transversely to the length of said plate, allowing sliding motion by a support carriage 8 of which the foot matches the shape of the T channels 6. The support carriage 8 is substantially composed of two side walls 9 having a base length less than the length of the T channels 6. A cross-plate 7 fitted with an aperture is present in the lower region of the support carriage 8 and connects the side walls 9.

For simplicity of manufacture, both the support carriage 8 and the base plate 1 are die-cast. As regards aircraft construction, aluminum is recommended foremost.

A bolt 11 is rotatably supported on a shaft 10 in the side walls 9. The outward end of the bolt 11 comprises a slide edge 12 along which the edge of the plate 5 will slide during closing as will be discussed below in relation to FIG. 2. A notch 13 is present at the other bolt end.

The end of a detent spring 14 bent into several angles enters said notch 13. The detent spring 14 bends around a pin 15, passes through an aperture in the cross-plate 7 of the support carriage 8 and terminates in a downward leg 17 in a trough 19 seating a spiral compression spring 20.

Various parameters may be used to control the overpressure at which the forced opening of the decompression locks shall take place. One way is to control the spring constant of the detent spring 14. Also, as shown by FIG. 1*b*, a rise in the triggering overpressure can be implemented by a pin 16 shortening the free length of the detent spring 14. Obviously the triggering overpressure also may be controlled by the position of the shaft 10, in other words by the ratio of the two lever arms of the bolt 11. Lastly the triggering overpressure also can be controlled by the geometry of the outer bounds of the side walls 9 designed as slide edges 21. Because in this triggering the upwardly escaping plate 5 forces the support carriage 8 back leftward, the spring constant of the compression spring 20 also will be a factor in the triggering pressure.

The object of the compression spring 20 is to force the support carriage 8 into the outer closed position. The end of the detent spring 14 entering the notch 13 serves to keep the bolt 11 in the shown closed position. The shape of the detent spring 14 is such that it fulfills two further functions besides catching the bolt 11. The lower end 17 of the detent spring 14 enters the trough 19 in such manner that it will stress the compression spring when the support carriage 8 and the bolt 11 are moved back. The T channel 6 requires no limit stops. The trough 19 and the lower end 17 of the detent spring 14 as well as the compression spring 20 limit the longitudinal displacement of the support carriage 8. If the pressure denoted by an arrow in FIG. 1*b* and acting on the plate 5 exceeds a predetermined value, then the detent spring 14 snaps out of the notch 13 and the bolt 11 pivots upward about the shaft 10 and allows the plate 5 to escape upward, this plate 5 in the process sliding along the slide edge 21 of the support carriage 8 which is forced leftward by the plate 5.

Assembly of the shown decompression lock is carried out in such a way that the bolt 11 is affixed in the support carriage 8 by the insertion of the shaft 10, whereupon the support carriage 8 is slipped into the channel 6 and then the detent spring 14 is inserted and fastened by means of the pins 15 and 16, and lastly the compression spring is inserted into the trough 19 when the support carriage 8 is in its final position and through the aperture shown in FIG. 1*c*.

An estimate of the size of the decompression lock is made possible by considering a total decompression-lock height from the underside of the base plate 1 to the uppermost position of the support carriage 8 being 18.6 mm. This dimension is typical for an aircraft decompression-lock. However the decompression lock of the invention also may be larger, for instance regarding the initially cited power plant locks.

Various activation phases of the seal of FIG. 1 are now elucidated in relation to FIGS. 2*a*–2*e*. The corresponding components are denoted by the same references as in FIG. 1. The plates to be connected to the sealing frame on which the decompression locks are mounted transversely again are denoted by 4 and 5. The compression spring 20 is inserted in the trough 19 of the base plate 1.

Figure 2A:
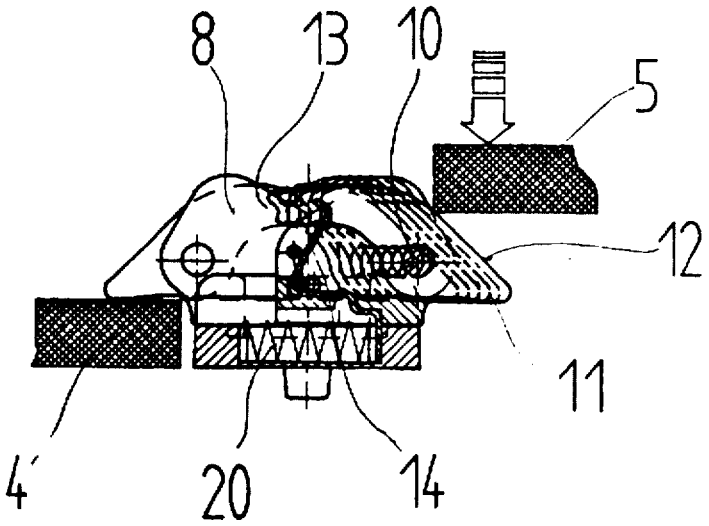

FIG. 2*a* shows the beginning of closure, during which the plate 5 is forced down. When descending, the plate 5 slides by its edge along the slide edge 12 of the bolt 11 and displaces this bolt 11 together with the support carriage 8 to the left. In the process the compression spring 20 is compressed by the lower end 17 of the detent spring 14 on account of said detent spring's motion until the bolt 11 and the support carriage 8 have reached the outermost left position of readiness shown in FIG. 2*b* and the plate 5 has come to its lowermost position.

Figure 2B:
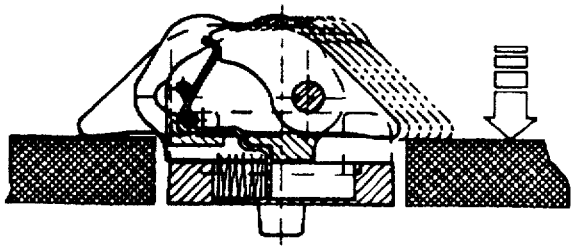

As shown by FIG. 2*b*, the support carriage 8 and the bolt 11 then move again rightward on account of the relaxation of the compression spring 20 into the closed position.

Figure 2C:
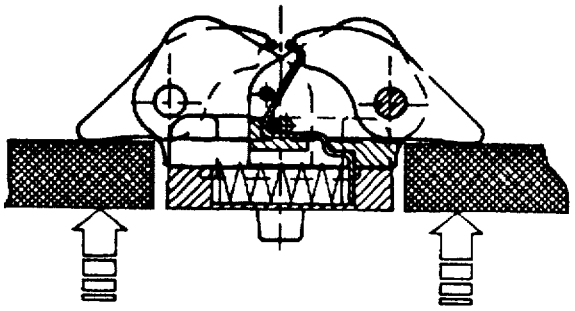

FIG. 2*c* shows the closed position with relaxed compression spring 20.

Figure 2D:
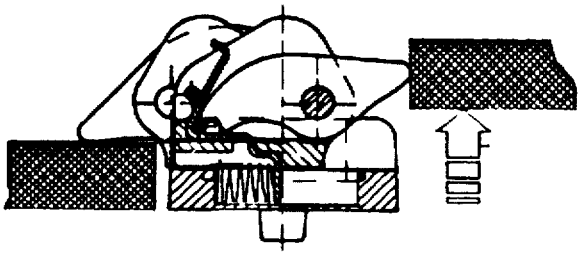

In FIG. 2*d*, the arrow at the underside of the plate 5 represents the forced opening caused by overpressure. The pressure on the plate 5 is large enough that the detent spring 14 no longer can retain the bolt 11 in the notch 13. As a result the bolt 11 is pivoted about the shaft 10. Before the plate 5 can escape upward, it must slide along the slide edge 21, whereby the support carriage 8 must move out of the way. As a result the overpressure is relieved.

Figure 2E:
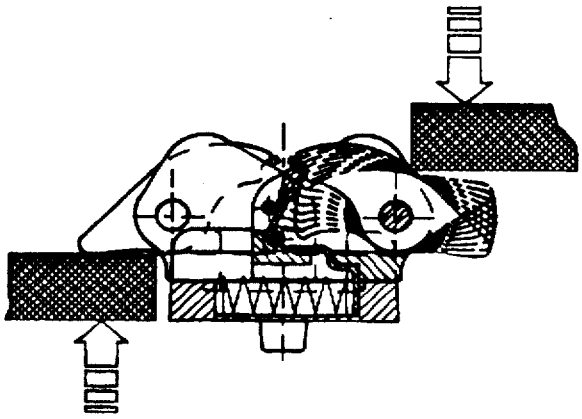

FIG. 2*e* shows how the decompression lock is moved into the ready position by forcing back the plate 5. In the process the plate 5 slides along the slide edge 12 of the bolt 11 and rotates this bolt about the shaft 10 until the end of the spring 14 snaps into the notch 13. As a result the decompression lock once more is in the ready position from which the closure process shown in FIG. 2*a* can then begin.

FIGS. 2*e* through 2*a* show that independently of its initial position, the decompression lock can be moved any time into the blocking position merely by pressing against the plate 5.

In the shown and described decompression locks, the purpose of the compression spring 20 is to automatically move the support carriage 8 and the bolt 11 into the closed position. The compression spring 20 will not be needed if the decompression lock is manually moved into the closed and open positions. In the latter case these limit positions shall be appropriately secured using detent devices.

I claim:

1. A decompression lock configured for opening when a predetermined pressure is exceeded, comprising:

a base plate having a trough;

a support carriage, longitudinally displaceable along a first axis, slidably supported on said base plate above said trough;

a bolt rotatably supported on said support carriage;

a detent spring fixed to the support carriage, said detent spring having an outer end for biasing said bolt in a closed position and for releasing said bolt from said closed position at a predetermined overpressure and said detent spring having an inner end disposed in said trough; and a compression spring disposed in said trough and abutting said inner end of said detent spring such that said support carriage and said bolt are biased in a locking position.

2. Decompression lock as claimed in claim 1, characterized in that the support carriage is longitudinally displaceable inside a T-channel in said base plate.

3. Decompression lock as claimed in claim 1, characterized in that the bolt has an oblique slide edge for moving said bolt to said closed position and for moving said support carriage from said locking position when a plate is pressed thereagainst in a direction substantially perpendicular to said first axis while said plate is moving from a first position at said bolt to a second position past said bolt towards said base plate;

wherein said support carriage is moved by the compression spring into the locking position when said plate is in said second position.

4. Decompression lock as claimed in claim 1, characterized in that a resilient end of the detent spring enters a notch in the bolt.

5. Decompression lock as claimed in claim 4, characterized in that said resilient end of the detent spring (14) is bounded by a pin (16).

6. Decompression lock as claimed in claim 1, wherein said support carriage has a slide edge disposed on an outer edge for displacing said support carriage when the decompression lock is forced open.

7. Decompression lock as claimed in claim 1, characterized in that two adjacent decompression locks operating in mutually opposite directions are mounted on a sealing frame joining two plates to one another.

8. Decompression lock as claimed in claim 7, characterized in that the two adjacent decompression locks open at different overpressures.

* * * * *